US005156671A

United States Patent [19]

Nakajima et al.

[11] Patent Number: 5,156,671

[45] Date of Patent: Oct. 20, 1992

[54] METHOD FOR DEPHOSPHORIZATION OF CHROMIUM-CONTAINING MOLTEN PIG IRON WITH REDUCED OXIDATION LOSS OF CHROMIUM

[75] Inventors: Yoshio Nakajima, Hiroshima; Masato Mukai, Kure; Katsunori Fukui, Shinnanyo, all of Japan

[73] Assignee: Nisshin Steel Co., Ltd., Japan

[21] Appl. No.: 651,384

[22] PCT Filed: Jun. 28, 1990

[86] PCT No.: PCT/JP90/00842

§ 371 Date: Mar. 6, 1991

§ 102(e) Date: Mar. 6, 1991

[87] PCT Pub. No.: WO91/00928

PCT Pub. Date: Jan. 24, 1991

[30] Foreign Application Priority Data

Jul. 8, 1989 [JP] Japan ..... 1-176424

[51] Int. Cl.[5] ..... C21C 7/02

[52] U.S. Cl. ..... 75/535

[58] Field of Search ..... 75/535

[56] References Cited

U.S. PATENT DOCUMENTS 4,356,032 10/1982 Morishita ..... 75/535

*Primary Examiner*—Peter D. Rosenberg

*Attorney, Agent, or Firm*—Lowe, Price, LeBlanc & Becker

[57] ABSTRACT

A method for the dephosphorization of a chromium-containing molten pig iron with a reduced oxidation loss of chromium wherein a solid-gas mixture of a particulate flux dispersed in an oxygen-containing gas is injected into the chromium-containing molten pig iron from a location below a surface level of the chromium-containing molten pig iron, the flux containing at least 70% by weight of CaO and $CaF_2$ in sum with a weight ratio of CaO to $CaF_2$ ($CaO/CaF_2$) of not lower than 4/6, the solid-gas mixture having an $O_2/(CaO+CaF_2)$ ratio within the range of from 20 to 120 Nl/kg wherein $O_2$ is an amount of oxygen in Nl contained in the oxygen-containing gas.

13 Claims, 4 Drawing Sheets

METHOD FOR DEPHOSPHORIZATION OF CHROMIUM-CONTAINING MOLTEN PIG IRON WITH REDUCED OXIDATION LOSS OF CHROMIUM

FIELD OF THE INVENTION

The invention relates to a method for the dephosphorization of chromium-containing molten pig (high carbon) iron with a reduced oxidation loss of chromium.

Recently a good deal of attention has been paid to processes for preparing chromium-containing molten pig iron or molten ferrochromium, as starting molten hot metal in the preparation of stainless steel, wherein an electric furnace is not used in order to save power. For example, there has been proposed a process wherein scrap is molten by combustion heat of a carbonaceous material such as cokes and at the same time a chromium ore is melt reduced by the carbonaceous material. In this case, since the oxygen potential in the materials is very low during the melt reduction, almost 100% of phosphorus contained in the materials transfers to the molten hot metal. Accordingly, in order to commercially carry out the processes for preparing starting molten hot metal in the preparation of stainless steel, wherein a carbonaceous material is used, it is essential to develop and establish a technology for the dephosphorization of molten pig iron containing chromium in high concentrations.

However, the dephosphorization of chromium-containing molten pig iron is very difficult, since chromium lowers the activity of phosphorus. In fact, if chromium-containing molten pig iron is processed by a known oxidation dephosphorization method which is effective for the dephosphorization of ordinary molten pig iron substantially free from chromium, the chromium contained is preferentially oxidized, posing such problems that the slag formed is solidified to retard the dephosphorization reaction and that the basicity of the slag is lowered to adversely affect the dephosphorization. In other words, while oxidation dephosphorization methods using materials of CaO-FeO series or $CaO-CaF_2$ series are well known for the dephosphorization of ordinary molten pig iron, when such oxidation dephosphorization methods are as such applied to the processing of chromium-containing molten pig iron, the oxidation of chromium preferentially proceeds and the desired dephosphorization of phosphorus does not substantially proceed.

For the dephosphorization of chromium-containing molten pig iron, there have been known methods wherein the chromium-containing molten pig iron is brought in contact with $CaC_2$, $Ca-CaF_2$ or $CaC_2-CaF_2$ under a non-oxidizing atmosphere. These methods, however, require the non-oxidizing atmosphere and pose problems in treating the formed slag.

To solve the problems, JP B 61-149,422 proposes a method wherein a flux of NaF-CaO series containing from 30 to 70% by weight of NaF is blown into chromium-containing molten pig iron by means of a non-oxidizing gas. This method, however, consumes a quantity of the expensive NaF-containing flux.

JP B 57-32,688 teaches that when an alkali metal carbonate such as $LiCO_3$ is caused to contact with chromium-containing molten pig iron which contains more than a certain amount, the dephosphorization of the chromium-containing molten pig iron proceeds.

This method again requires an expensive dephosphorizing agent.

JP B 61-403 discloses a method for the dephosphorization of chromium-containing molten pig iron wherein a flux of $BaO-BaCl_2$ series is used. The BaO used therein is again an expensive alkaline substance. Furthermore, it is recommended to use chromium oxide as the oxygen source for the dephosphorization, for the reason that use of iron oxide or gaseous oxygen for that purpose will oxidize chromium.

JP B 63-481 teaches that when a slag comprising from 10 to 40% by weight of CaO, from 5 to 40% by weight of FeO, from 40 to 80% by weight of $CaF_2$ and not more than 10% by weight of $SiO_2$ is contacted and stirred with chromium-containing molten pig iron having an Si content of not higher than 0.2% and a C content of at least 4%, the dephosphorization of the chromium-containing molten pig iron proceeds.

As discussed above, there have been proposed various methods for dephosphorizing chromium-containing molten pig iron while suppressing oxidation of the chromium. The underlying idea of all these known methods is to preferentially fix P or $P_2O_5$ to strongly basic substances such as alkali or alkaline earth metals, or their oxides, chlorides or carbonates, while controlling the supply of oxygen which may oxidize the chromium, and to separate the so fixed phosphorus from the metal bath. It has been considered inapplicable and impractical to form $P_2O_5$ using a strong oxidizing material and to separate it by fixation to a flux material such as $CaO-CaF_2$ series. Thus, the methods for the dephosphorization of chromium-containing molten pig iron which have heretofore been proposed are economically limited, since quantities of an expensive strongly basic substance must be used together with quantities of a slag formation promoter ($CaF_2$, NaF and $BaCl_2$). Furthermore, the known methods are associated with an additional problem in that the life of a refractory used is shortened.

OBJECT OF THE INVENTION

An object of the invention is to solve the above discussed problems associated with the prior art methods for the dephosphorization of chromium-containing molten pig iron. More particularly, an object of the invention is to provide a method for the dephosphorization of chromium-containing molten pig iron wherein inexpensive materials of CaO series are used as in the dephosphorization of ordinary molten pig iron and an oxygen gas is as the oxygen source required for the dephosphorization is supplied into the chromium-containing molten pig iron under such conditions that they may unexpectedly cause the desired dephosphorization to properly proceed while suppressing the undesired oxidation of chromium.

DETAILED DESCRIPTION

We have carried out many experiments wherein a particulate flux of $CaO-CaF_2$ series dispersed in a carrier gas is directly injected into chromium-containing molten pig iron and wherein the composition of the particulate flux and the oxidizing condition of the injected solid-gas mixture are varied, and have found that if the composition of the particulate flux and the oxidizing condition of the injected solid-gas mixture are appropriately adjusted, the dephosphorization of the chromium-containing molten pig iron may proceed without being suffered from substantial oxidation of chromium.

Thus, the invention provides a method for the dephosphorization of chromium-containing molten pig iron having a chromium content of at least 3% by weight with a reduced oxidation loss of chromium comprising adding an oxygen source for oxidizing P contained in said chromium-containing molten pig iron and a particulate flux of $CaO$-$CaF_2$ series, characterized in that a solid-gas mixture of a particulate flux dispersed in an oxygen-containing gas is injected into said chromium-containing molten pig iron from a location below a surface level of said chromium-containing molten pig iron, said flux containing at least 70% by weight of CaO and $CaF_2$ in sum with a weight ratio of CaO to $CaF_2$ ($CaO/CaF_2$) of not lower than 4/6, said solid-gas mixture having an $O_2/(CaO+CaF_2)$ ratio within the range of from 20 to 120 Nl/kg wherein $O_2$ is an amount of oxygen in Nl contained in said oxygen-containing gas.

In the method according to the invention it is essential to use a solid-gas mixture formulated so that it may have the composition and oxidizing condition as prescribed above and to inject the solid-gas mixture into the chromium-containing molten pig iron from a location below a surface level of the chromium-containing molten pig iron. The injection may be carried out through a nozzle or nozzles provided on the bottom or side walls of a vessel containing the chromium-containing molten pig iron. Alternatively, a nozzle or nozzles protected by a refractory material may be submerged in the chromium-containing molten pig iron, and through such nozzle or nozzles the solid-gas mixture may be injected into the chromium-containing molten pig iron. The chromium-containing molten pig iron which can be treated herein has a chromium content of at least 3% by weight, usually at least 8% by weight, and normally contains in addition to P considerably high concentrations of C and S.

The particulate flux used herein is formulated so that it comprises CaO and $CaF_2$ with a weight ratio of CaO to $CaF_2$ ($CaO/CaF_2$) of not lower than 4/6. Thus, the flux is characterized in that it contains CaO in a relatively high proportion and $CaF_2$ in a relatively low proportion. Since an unduly high weight ratio of CaO to $CaF_2$ is not productive of good results, we prefer $CaO/CaF_2$ of not in excess of 7/3 (=2.333). The oxygen source necessary to oxidize the phosphorus dissolved in the chromium containing molten pig iron to phosphorus oxide is supplied by the solid-gas mixture. The oxygen source may be supplied solely by a gas phase of the solid-gas mixture. In other words, the oxygen gas contained in the gas-solid mixture can be a whole oxygen source for the dephosphorization. In the method according to the invention oxidation of chromium does not substantially proceed in spite of the fact that oxygen gas is fed into chromium-containing molten pig iron. This is contrary to the prior art disclosure discussed above.

A part of the oxygen source to oxidize P in the chromium-containing molten pig iron may be supplied by the particulate flux that is a solid phase of the solid-gas mixture. Specifically, the particulate flux may be incorporated with particulate iron oxide which, when fed into the chromium-containing molten pig iron, may act as the oxygen source to oxidize P. In this case again, the flux comprises at least 70% by weight of CaO and $CaF_2$ in sum, and thus, correspondingly up to 30% by weight of particulate iron oxide. In cases wherein a part of the oxygen source to oxidize P is supplied by the particulate flux, the solid gas mixture should have a $\Sigma O_2/(CaO+CaF_2)$ ratio within the range of from 20 to 120 Nl/kg wherein $\Sigma O_2$ is a sum of an amount of oxygen in Nl contained in said oxygen-containing gas and an amount of oxygen in Nl which will be generated when the iron oxide contained in said flux is decomposed to Fe and $O_2$.

The particulate flux used herein may be formulated from industrial grade quick lime and naturally occurring fluorite. Fluorite usable herein may contain at least 5% by weight of $SiO_2$ so far as it contains at least 70% by weight of $CaF_2$. While it has been generally considered in the art that $SiO_2$ lowers the basicity of the slag, and in consequence, adversely affects the dephosphorization, in the method according to the invention use can be advantageously made of inexpensive, low grade fluorite having a relatively high $SiO_2$ content.

Thus, by the method for the dephosphorization of chromium-containing molten pig iron according to the invention wherein an oxygen-containing gas is injected into chromium-containing molten pig iron, if a particulate flux is dispersed in an concurrently injected together with the oxygen-containing gas into the chromium-containing molten pig iron under the conditions prescribed herein, the desired dephosphorization proceeds while suppressing the undesired oxidation of chromium. Even in a case where the molten pig iron has a considerably high chromium content, the method according to the invention does not suffer from substantial oxidation loss of chromium. This unexpected result is believed to be achieved at least partly because the flux and oxygen gas are simultaneously injected into chromium-containing molten pig iron from the same location below a surface level of the chromium-containing molten pig iron. Thus, phosphorus oxide formed by the reaction of oxygen introduced into the molten metal with phosphorus in the system, immediately reacts with and CaO existing around the reaction sites and is fixed thereto. These reactions proceed unidirectionally and continuously. The temperature of the reaction sites do not become very high since the reaction between phosphorus oxide and CaO is endothermic and the injection of the solid flux brings about some cooling effect. For these reasons, it is considered that the formation of phosphorus oxide and its fixation to the flux proceed preferentially to the oxidation of chromium. Accordingly, the amount of the flux supplied to the reaction sites may be such that it can continuously fix the continuously formed phosphorus oxide. This means that the method according to the invention ensures effective dephosphorization using much less amount of the flux with a reduced proportion of $CaF_2$ when compared with the prior art dephosphorization methods wherein a large amount of flux is supplied on the surface of the molten metal. In addition, the slag formed in the method according to the invention is frequently in the semi-molten condition so that it does not impair refractories used in the refining vessel. Furthermore, in the method for the dephosphorization of chromium-containing molten pig iron according to the invention the desulfurization of the chromium-containing molten pig iron proceeds as well.

EXAMPLES

Experiments were carried out using a crucible-like refining vessel having an inner diameter of 36 cm. The vessel is lined with a MgO-14%C refractory and surrounded by a high frequency coil of 450 kw. On the side wall of the vessel there is installed an injection nozzle in such a manner that it penetrates through the side wall and may inject a flux and carrier gas obliquely downwards in a direction toward approximately the center of the bottom of the vessel. The nozzle has an inner diameter of 5 mm and is made of a ceramic material of $Si_3N_4$ series. When this vessel contains about 300 kg of chromium-containing molten pig iron, the nozzle is at a level of about 8 cm below the surface of the molten hot metal. When the vessel contains about 300 kg of a content, the content can be heated at a rate of 30° C./min. by application of a high frequency power to the high frequency coil. In the experiments described below, the temperature of chromium-containing molten pig iron was controlled in the range from 1470° to 1500° C. by application of a high frequency power.

Using the refining vessel, 300 kg of chromium-containing molten pig iron was prepared and a flux of $CaO-CaF_2$ series was directly injected into the chromium-containing molten pig iron through the injection nozzle by means of an oxygen-containing carrier gas. The chromium concentration of the molten pig iron, the $CaO/CaF_2$ ratio of the flux and the oxidizing condition that is the $O_2/(CaO+CaF_2)$ ratio of the solid-gas mixture were varied as described below. Near the nozzle port contacting the molten hot metal, a new nozzle port defined by a solidified product was formed by cooling effect of the injected particulate flux and inhibited loss of nozzle due to melting.

Figure 1:
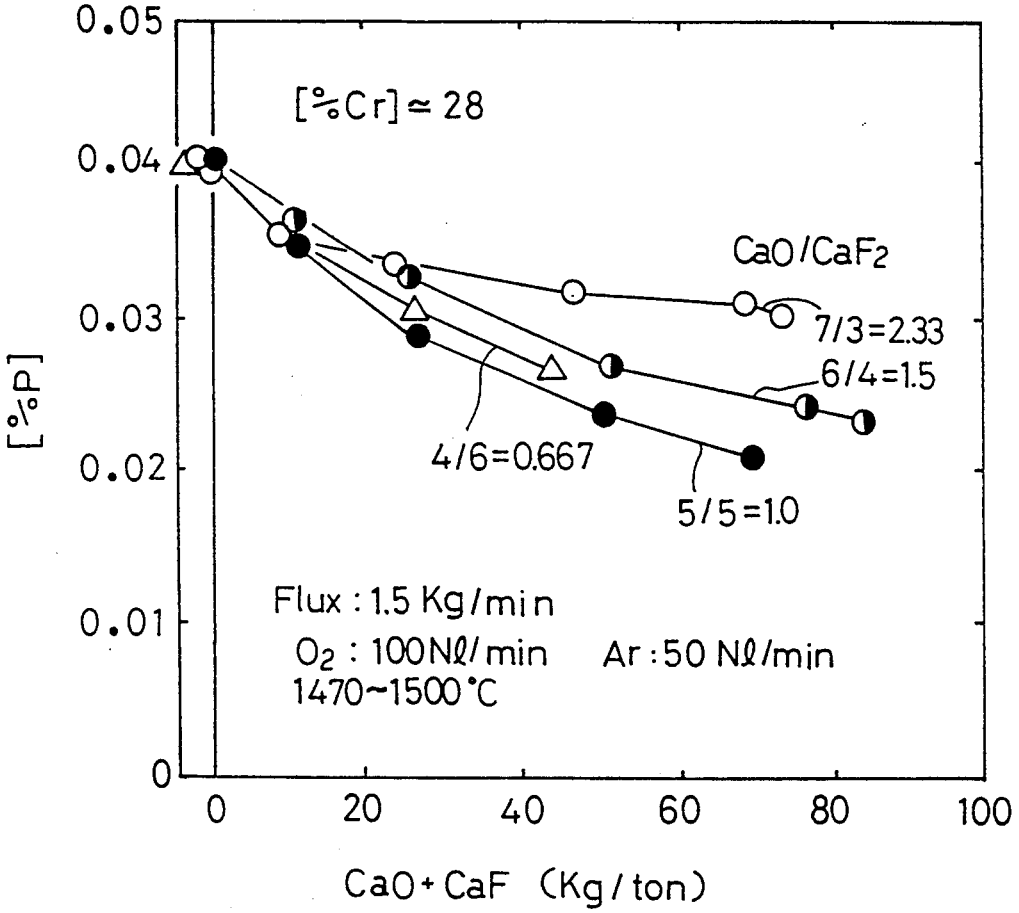
FIG. 1 graphically depicts influence of the $CaO/CaF_2$ ratio on the dephosphorization, when chromium-containing molten pig iron having a chromium content of about 28% by weight is processed by the method according to the invention.

FIG. 1 shows graphs of the phosphorus content of the metal after the treatment plotted against the total amount (kg/ton) of the injected ($CaO+CaF_2$), when a flux consisting essentially of CaO and $CaF_2$ with the indicated $CaO/CaF_2$ ratio carried by a mixed gas of oxygen and argon was injected into chromium-containing molten pig iron having a chromium content of 28%, a carbon content of 6% and a phosphorus content of 0.04%. During the injection of the experiments of FIG. 1, the feed rate of the carrier gas was kept constant with 100 Nl/min. of $O_2$ and 50 Nl/min. of Ar. The feed rate of the flux was also kept constant at 1.5 kg/min. Accordingly, the $O_2/(CaO+CaF_2)$ ratio of the solid gas mixture was constant at 100/1.5=66.67 Nl/kg. The abscissa indicates the total amount (kg/ton) of the injected ($CaO+CaF_2$) which is proportional, in these experiments, to the time of injection under the constant conditions mentioned above. The temperature of the metal was maintained within the range of from 1470° to 1500° C.

In FIG. 1, blank circles ○ show data in the case wherein the $CaO/CaF_2$ ratio was 7/3=2.33, semi-solid circles ◑ data in the case wherein the $CaO/CaF_2$ ratio was 6/4=1.5, solid circles ● data in the case wherein the $CaO/CaF_2$ ratio was 5/5=1.0, and blank triangles Δ data in the case wherein the $CaO/CaF_2$ ratio was 4/6=0.67.

FIG. 1 reveals that the dephosphorization of chromium-containing molten pig iron satisfactorily proceeds in spite of the fact that the chromium-containing molten pig iron has a chromium content as high as 28%. This is unexpected in view of the prior art prejudice that the oxidation dephosphorization of chromium-containing molten pig iron with a flux of $CaO-CaF_2$ series would become impossible as the chromium content approaches about 30%. Furthermore, it is noted from FIG. 1 that while the dephosphorization efficiency increases as the $CaO/CaF_2$ ratio decreases from 7/3 to 5/5, the dephosphorization efficiency with a $CaO/CaF_2$ ratio of 4/6 is lower than that with a $CaO/CaF_2$ ratio of 5/5, indicating that the $CaO/CaF_2$ ratio should not be too low. This is also unexpected. In the prior art it has been considered primarily from the viewpoint of sufficient fluidity of the slag that $CaF_2$ as the fluxing agent will be required in an amount more than the amount of CaO as the dephosphorizing agent. Thus, effective dephosphorization has not been achieved in the prior art dephosphorization methods unless a $CaO/CaF_2$ ratio (in the case of $CaO-CaF_2$ series), a CaO/NaF ratio (in the case of CaO-NaF series), or a $BaO/BaCl_2$ ratio (in the case of $BaO-BaCl_2$ series) of substantially lower than 5/5 is used. As discussed hereinbefore this condition is disadvantageous in both the cost and processability aspects since use of the expensive fluxing agent in large amounts not only increases the processing costs but also promotes melting loss of refractories. To the contrary, the best dephosphorization efficiency is obtained with a $CaO/CaF_2$ ratio of 5/5 in the experiments of FIG. 1. In this condition the slag was semi-molten. Probably on that account, appreciable melting loss of the refractories was not observed.

Figure 2:
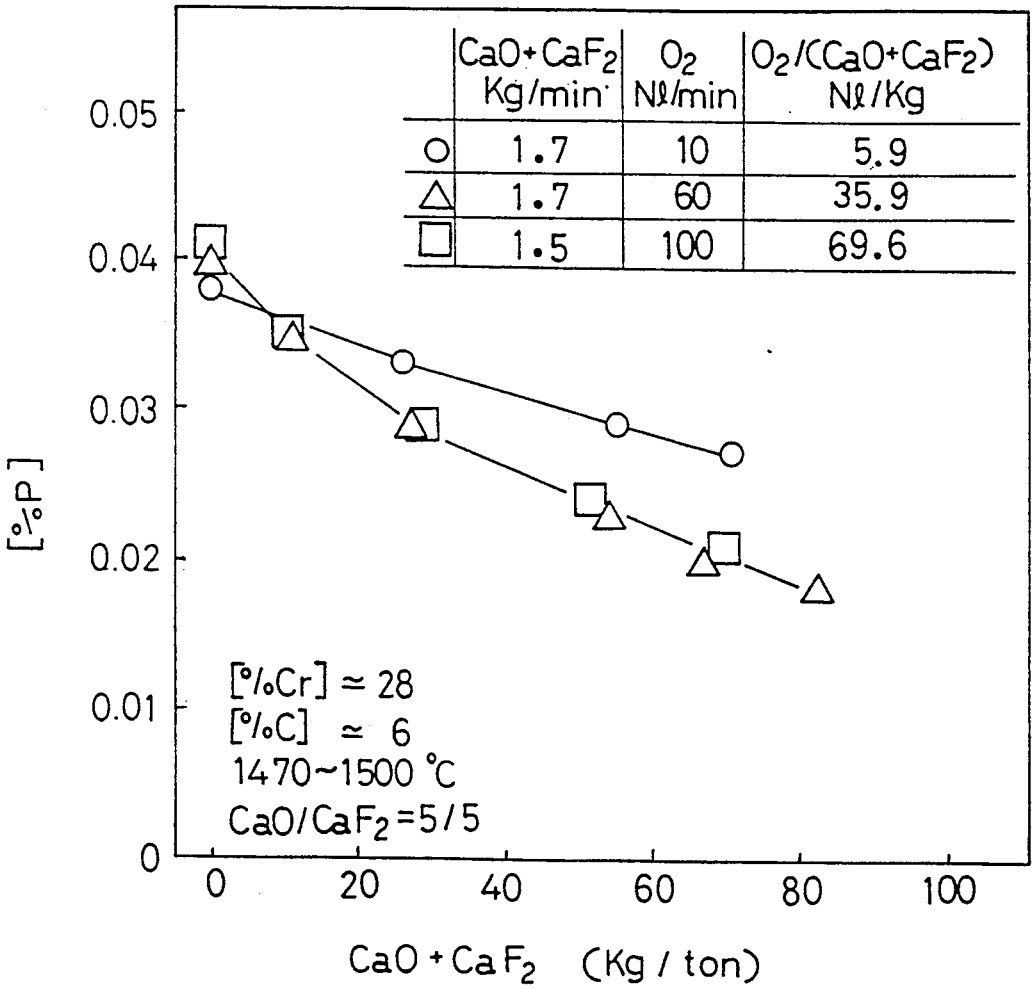
FIG. 2 graphically shows influences of the ($CaO+CaF_2$) feed rate and the $O_2/(CaO+CaF_2)$ ratio on the dephosphorization, when chromium-containing molten pig iron having a chromium content of about 28% by weight is processed by the method according to the invention.

FIG. 2 depicts the behavior of phosphorus when a flux consisting essentially of CaO and $CaF_2$ with a $CaO/CaF_2$ ratio of 5/5 was injected into the same chromium-containing molten pig iron having a chromium content of 28% as used in the experiments of FIG. 1 using various $O_2/(CaO+CaF_2)$ ratios indicated in FIG. 2. It can be understood from FIG. 2 that while the dephosphorization does not satisfactorily proceed if the $O_2/(CaO+CaF_2)$ ratio is as low as 5.9 Nl/kg as shown by blank circles ○, the dephosphorization satisfactorily proceeds as this ratio exceeds a certain value (about 35 Nl/kg as shown by blank triangles Δ. This indicates that it is necessary to continuously supply at least a certain amount of oxygen into the molten hot metal.

Figure 3:
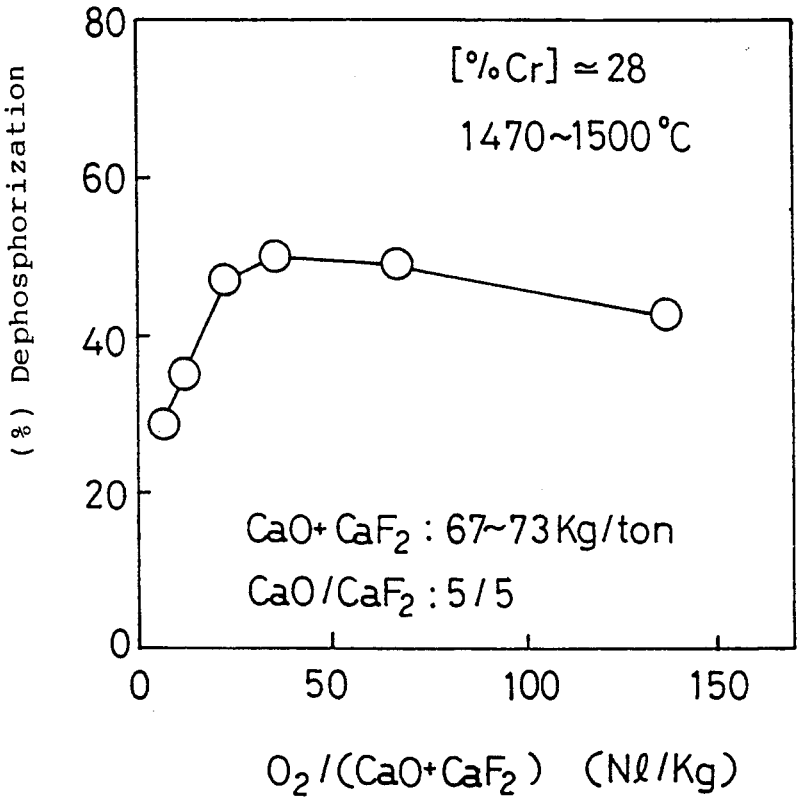
FIG. 3 is a graph of the % dephosphorization plotted against the $O_2/(CaO+CaF_2)$ ratio, when chromium-containing molten pig iron having a chromium content of about 28% by weight is processed by the method according to the invention.

FIG. 3 shows the % dephosphorization when 67–73 kg/ton of a flux consisting essentially of CaO and $CaF_2$ with a $CaO/CaF_2$ ratio of 5/5 was injected into the same chromium-containing molten pig iron with varied $O_2/(CaO+CaF_2)$ ratios as in the experiments of FIG. 2. As seen from FIG. 3, the % dephosphorization is maximum where the $O_2/(CaO+CaF_2)$ ratio is about 35

Nl/kg. The % dephosphorization is not further enhanced even if the oxidizing power is further increased by increasing the $O_2/(CaO+CaF_2)$ ratio, indicating that there is an appropriate range for the $O_2/(CaO+CaF_2)$ ratio. It has been found that if the $O_2/(CaO+CaF_2)$ ratio exceeds that range, there only results in increase of the oxidation loss of chromium. In the experiments of FIG. 3, the optimum oxidation condition can be represented by an $O_2/(CaO+CaF_2)$ ratio of about 35 Nl/kg or higher. However, the optimum oxidation condition may vary depending upon particular processing parameters concerned including, for example, conditions of stirring the molten hot metal, configuration of the refining vessel, manner of injecting the solid-gas mixture, feeding rate of the flux, and fluidity of the slag formed. Accordingly, a particular $O_2/(CaO+CaF_2)$ ratio employed should be appropriately selected depending upon particular processing parameters concerned. In most cases the $O_2/(CaO+CaF_2)$ ratio may be within the range between 20 Nl/kg and 120 Nl/kg. While in the illustrated experiments gaseous oxygen was used as a sole oxygen source for the dephosphorization purpose, a solid oxygen source may be used in addition to the gaseous oxygen source by incorporating the particulate flux with an appropriate amount of the solid oxygen source such as mill scale and iron ores. In this case, the $\Sigma O_2/(CaO+CaF_2)$ ratio selected within the range of from 20 to 120 Nl/kg wherein $\Sigma O_2$ is a sum of an amount of $O_2$ in Nl contained in the carrier gas and an amount of oxygen in Nl which will be generated when the iron oxide (the solid oxygen source such as mill scale and iron ores) contained in the flux is decomposed to Fe and $O_2$. Use of the solid oxygen source, however, substantially lowers the temperature of the molten hot metal, and is disadvantageous from the viewpoint of heat compensation. Furthermore, we have experienced that the solid oxygen source invites a larger oxidation loss of chromium than the gaseous oxygen source. Accordingly, if any solid oxygen source is used, it should be incorporated in the particulate flux in such a restricted amount that the weight of the solid oxygen source does not exceeds 30% by weight based on the combined weight of the particulate flux and the solid oxygen source. The smaller the amount of the solid oxygen source used the better. No solid oxygen source should preferably be used, if the case allows.

Figure 4:
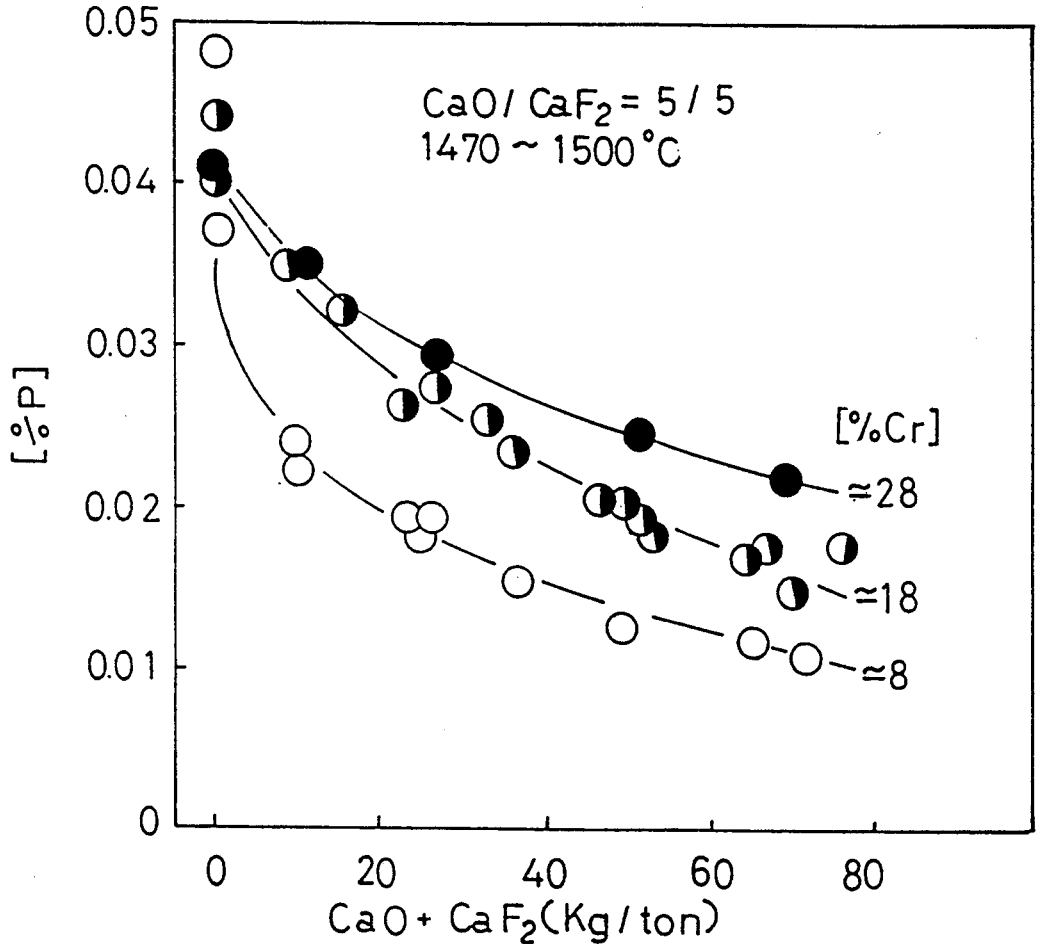
FIG. 4 graphically depicts influence of the ($CaO+CaF_2$) feed rate on the dephosphorization, when chromium-containing molten pig irons having various chromium contents are processed by the method according to the invention.

FIG. 4 depicts the behavior of phosphorus when a flux consisting essentially of CaO and $CaF_2$ with a $CaO/CaF_2$ ratio of 5/5 was injected into chromium-containing molten pig iron maintained at a temperature of from 1470° to 1500° C. and having the indicated chromium content by the method according to the invention. The feed rate of $(CaO+CaF_2)$ was about 1.5 kg/min., and the flow rate of $O_2$ was within the range of from 100 to 170 Nl/min. FIG. 4 reveals that chromium-containing molten pig iron having a chromium content of about 8% can be readily dephosphorized by the method according to the invention. Chromium-containing molten pig iron having a chromium content as high as about 28% can also be effectively dephosphorized by the method according to the invention.

Table 1 shows changes in components Cr, P, S and C of metal before and after treatment in Examples similar to the experiments illustrated above. In all Examples, the feed rate of $(CaO+CaF_2)$ was about 1.5 kg/min., and the flow rate of $O_2$ was about 100 Nl/min. Thus, the $O_2/(CaO+CaF_2)$ ratio was maintained at an approximately constant value of about 66.7 Nl/kg. For a comparative purpose, chromium-containing molten pig iron having a chromium content of about 28% was dephosphorized in Comparative Example according to a prior art method, in which the chromium-containing molten pig iron was stirred in a 300 kg high frequency electric furnace with argon and the flux was added on the surface of the molten pig iron. Results are shown in Table 1.

In Comparative Example 1 where a $CaO/CaF_2$ ratio of 5/5 was used, slag formation did not satisfactorily proceed, and the achieved % dephosphorization was only 16%. Whereas in Examples 1–4 according to the invention where a $CaO/CaF_2$ ratio of 5/5 or 6/4 forming a semi-molten slag was used, a high % dephosphorization could be achieved using a less amount of flux, oxidation of Cr scarcely occurred in spite of the fact that gaseous oxygen was used as an oxidizer, and the desulfurization also proceeded.

TABLE 1

| | Flux | | | | Change in component before and after treatment (wt %) | | | | | | | |
|---|---|---|---|---|---|---|---|---|---|---|---|---|
| | CaO/ | Unit | Oxi- | Mode of | [% Cr] | | [% P] | | [% S] | | [% C] | |
| | $CaF_2$ | (kg/ton) | dizer | treatment | Before | After | Before | After | Before | After | Before | After |
| Ex. 1 | 6/4 | 84 | $O_2$ | Injection | 28.38 | 27.96 | 0.041 | 0.023 | 0.042 | 0.010 | 6.12 | 5.60 |
| Ex. 2 | 5/5 | 70 | $O_2$ | Injection | 28.36 | 28.22 | 0.041 | 0.021 | 0.047 | 0.012 | 6.19 | 5.72 |
| Ex. 3 | 5/5 | 70 | $O_2$ | Injection | 17.61 | 17.13 | 0.044 | 0.014 | 0.047 | 0.012 | 5.58 | 5.06 |
| Ex. 4 | 5/5 | 72 | $O_2$ | Injection | 8.10 | 8.06 | 0.048 | 0.010 | 0.051 | 0.012 | 5.04 | 4.52 |
| Comp. Ex. 1 | 5/5 | 80 | $Cr_2O_3$ | * | 28.00 | 28.10 | 0.043 | 0.036 | 0.045 | 0.001 | 6.23 | 5.91 |

*Addition on the metal surface and stirring with Ar.

The invention is further illustrated by Examples in which 5 tons of chromium-containing molten pig iron was treated by the method according to the invention.

The formulation (in % by weight) of the injected particulate fluxes is shown in Table 2. Flux I contained 10% by weight of mill scale. Flux II contained 15% by weight of limestone. Pulverized naturally occurring fluorite was used as such in Flux I and II as the $CaF_2$ source. Analysis of the fluorite is shown in Table 3. It contained 13.6% by weight of $SiO_2$ addition to about 80% by weight of $CaF_2$. Both Flux I and II had a $CaO/CaF_2$ ratio within the range of from 1.2 to 1.3.

A refining vessel equipped with an injection nozzle on its side wall was charged with 5 ton of chromium-containing molten pig iron, and Flux I or II was injected into the molten hot metal through the nozzle by means of a carrier gas containing gaseous oxygen. The nozzle had a nozzle port at a level about 25 cm below the surface of the molten hot metal and obliquely inclined downwards in a direction towards approximately the center of the bottom of the vessel. During the treatment the temperature of the molten hot metal was in the range from 1470° C. and 1310° C.(about 1400° C. on average). The carrier gas was a mixture of argon and oxygen gases. Under the treating conditions indicated in Table 4, dephosphorization of chromium-containing molten pig iron was carried out by the method according to the invention.

Analysis of metal before and after treatment is shown in Table 5. Analysis of slag after treatment is shown in Table 6.

In these Examples, fluorite containing 13.6% of $SiO_2$ was used (Table 3) and the chromium-containing molten pig iron had a silicon content of about 0.15% at the beginning of the treatment (Table 5). For these reasons, as seen from Table 6, the $SiO_2$ concentration of the slag reached about 10% after treatment, and in Example (c) the basicity ($CaO/SiO_2$) of slag was below 3.

Even under such a low basicity of slag, the dephosphorization effectively proceeded, and % dephosphorization as high as 42–49% (Table 5) was achieved with use of a reduced amount (40–60 kg/ton) of flux. In addition, the desulfurization satisfactorily proceeded as well. As to Cr, in cases wherein the $\Sigma O_2/(CaO+CaF_2)$ ratio was 52–56 Nl/kg as in Examples (b) and (d), the chromium concentration of metal before and after treatment was 11.96/11.92 (%) in Example (b) or 12.25/12.29 (%) in Example (d), indicating no appreciable oxidation loss of Cr. In Examples (a), (c) and (e), the oxidation power of the system was increased by using a higher $\Sigma O_2/(CaO+CaF_2)$ ratio. In the latter Examples, some oxidation loss of chromium was observed although the dephosphorization efficiency was not affected. It can be understood that there is an optimum oxidation condition. The optimum oxidation condition in the illustrated Examples may be represented by the $\Sigma O_2/(CaO+CaF_2)$ ratio of about 50 Nl/kg.

TABLE 2

| | Formulation of particulate flux (wt. %) | | | |
|---|---|---|---|---|
| | Quick lime | Fluorite | Limestone | Mill scall |
| Flux I | 45 | 45 | — | 10 |
| Flux II | 40 | 45 | 15 | — |

TABLE 3

| Analysis of fluorite (wt. %) | |
|---|---|
| $CaF_2$ | $SiO_2$ |
| 80.1 | 13.6 |

TABLE 4

| | Treating conditions (5 ton of hot metal) | | | | | |
|---|---|---|---|---|---|---|
| | Flux | Treating time (min.) | Average treating temperature | Feed rate of flux (kg/min.) | Feed rate of $O_2$ ($Nm^3$/min.) | $\Sigma O_2/(CaO+CaF_2)$ |
| Ex. (a) | I | 7.1 | 1372° C. | 28.2 | 1.5 | 78.4 |
| Ex. (b) | | 7.4 | 1396° C. | 34.1 | 1.0 | 51.9 |
| Ex. (c) | | 9.0 | 1400° C. | 31.8 | 2.0 | 89.2 |
| Ex. (d) | II | 9.3 | 1395° C. | 26.7 | 1.5 | 56.2 |
| Ex. (e) | | 9.6 | 1404° C. | 25.9 | 2.0 | 77.3 |

TABLE 5

| | Analysis of metal (wt. %) before and after treatment (Before/After) | | | | | |
|---|---|---|---|---|---|---|
| | [% C] | [% Si] | [% P] | [% S] | [% Cr] | % Dephosphorization |
| Ex. (a) | 5.64/5.44 | 0.13/0.03 | 0.043/0.025 | 0.049/0.010 | 12.21/11.76 | 42 |
| Ex. (b) | 5.71/5.81 | 0.15/tr | 0.042/0.024 | 0.066/0.016 | 11.96/11.92 | 43 |
| Ex. (c) | 5.56/5.34 | 0.20/0.01 | 0.041/0.022 | 0.065/0.013 | 12.30/11.92 | 46 |
| Ex. (d) | 5.64/5.40 | 0.14/0.03 | 0.039/0.020 | 0.047/0.010 | 12.25/12.29 | 49 |
| Ex. (e) | 5.36/5.12 | 0.16/0.04 | 0.039/0.022 | 0.047/0.012 | 11.97/11.72 | 44 |

TABLE 6

| | Analysis of slag (wt. %) after treatment | | | | |
|---|---|---|---|---|---|
| | CaO | $CaF_2$ | $SiO_2$ | $CaO/SiO_2$ | $CaO/CaF_2$ |
| Ex. (a) | 36.4 | 22.6 | 11.0 | 3.30 | 1.61 |
| Ex. (b) | 33.8 | 23.0 | 9.5 | 3.54 | 1.47 |
| Ex. (c) | 33.8 | 22.0 | 11.7 | 2.90 | 1.54 |
| Ex. (d) | 33.8 | 25.7 | 10.2 | 3.82 | 1.51 |
| Ex. (e) | 32.5 | 21.1 | 10.1 | 3.22 | 1.53 |

By the method according to the invention, chromium-containing molten pig iron can be effectively dephosphorized without substantial oxidation loss of chromium using an inexpensive flux in a reduced amount (the amount of $CaF_2$ used is also reduced). The slag formed can be in the semi-molten condition, and thus, melting loss of refractory is small. Chromium-containing molten pig iron having a chromium content as high as about 30%, the dephosphorization of which has heretofore been considered impossible with a flux of $CaO$-$CaF_2$ series, can also dephosphorized by the method according to the invention. Furthermore, reduction in temperature of the metal during treatment is small in the method according to the invention, since gaseous oxygen is used as the oxygen source.

We claim:

1. A method for the dephosphorization of chromium-containing molten pig iron having a chromium content of at least 3% by weight with a reduced oxidation loss of chromium comprising injecting a solid-gas mixture of a particulate flux dispersed in an oxygen-containing gas into said chromium-containing molten pig iron from a location below a surface level of said chromium-containing molten pig iron, said flux containing at least 70% by weight of CaO and $CaF_2$ in sum with a weight ratio of CaO to $CaF_2$ ($CaO/CaF_2$) within the range between 7/3 and 4/6, said solid-gas mixture having an $O_2/(CaO+CaF_2)$ ratio within the range of from 20 to 120 Nl/kg wherein $O_2$ is an amount of oxygen in Nl contained in said oxygen-containing gas.

2. A method for the dephosphorization of chromium-containing molten pig iron having a chromium content of at least 3% by weight with a reduced oxidation loss of chromium comprising injecting a solid-gas mixture of a particulate flux dispersed in an oxygen-containing gas into said chromium-containing molten pig iron from a location below a surface level of said chromium-containing molten pig iron, said flux containing at least 70% by weight of CaO and $CaF_2$ in sum with a weight ratio of CaO to $CaF_2$ ($CaO/CaF_2$) within the range between 7/3 and 4/6, the balance being iron oxide and unavoidable impurities, said solid-gas mixture having a $\Sigma O_2/(CaO+CaF_2)$ ratio within the range of from 20 to 120 Nl/kg wherein $\Sigma O_2$ is a sum of an amount of oxygen in Nl contained in said oxygen-containing gas and an amount of oxygen in Nl which will be generated when the iron oxide contained in said flux is decomposed to Fe and $O_2$.

3. The method for the dephosphorization of a chromium-containing molten pig iron according to claim 1, wherein said chromium-containing molten pig iron has a chromium content of from 8 to 30% by weight.

4. The method for the dephosphorization of a chromium-containing molten pig iron according to claim 1, wherein said solid-gas mixture is injected into said chromium-containing molten pig iron through a nozzle or nozzles provided on a bottom or side portion or portions of a vessel containing said chromium-containing molten pig iron.

5. The method for the dephosphorization of a chromium-containing molten pig iron according to claim 1, wherein said particulate flux is formulated from quick lime and naturally occurring fluorite containing at least 70% by weight of $CaF_2$ and at least 5% by weight of $SiO_2$.

6. The method for the dephosphorization of a chromium-containing molten pig iron according to claim 2 wherein said chromium-containing molten pig iron has a chromium content of from 8 to 30% by weight.

7. The method for the dephosphorization of a chromium-containing molten pig iron according to claim 1 wherein said chromium-containing molten pig iron has a chromium content of from 8 to 30% by weight.

8. The method for the dephosphorization of a chromium-containing molten pig iron according to claim 2 wherein said solid-gas mixture is injected into said chromium-containing molten pig iron through a nozzle or nozzles provided on a bottom or side portion or portions of a vessel containing said chromium-containing molten pig iron.

9. The method for the dephosphorization of a chromium-containing molten pig iron according to claim 1 wherein said solid-gas mixture is injected into said chromium-containing molten pig iron through a nozzle or nozzles provided on a bottom or side portion or portions of a vessel containing said chromium-containing molten pig iron.

10. The method for the dephosphorization of a chromium-containing molten pig iron according to claim 3 wherein said solid-gas mixture is injected into said chromium-containing molten pig iron through a nozzle or nozzles provided on a bottom or side portion or portions of a vessel containing said chromium-containing molten pig iron.

11. The method for the dephosphorization of a chromium-containing molten pig iron according to claim 2 wherein said particulate flux is formulated from quick lime and naturally occurring fluorite containing at least 70% by weight of $CaF_2$ and at least 5% by weight of $SiO_2$.

12. The method for the dephosphorization of a chromium-containing molten pig iron according to claim 3 wherein said particulate flux is formulated from quick lime and naturally occurring fluorite containing at least 70% by weight of $CaF_2$ and at least 5% by weight of $SiO_2$.

13. The method for the dephosphorization of a chromium-containing molten pig iron according to claim 4 wherein said particulate flux is formulated from quick lime and naturally occurring fluorite containing at least 70% by weight of $CaF_2$ and at least 5% by weight of $SiO_2$.

* * * * *